US011866234B2

(12) United States Patent
Borger et al.

(10) Patent No.: US 11,866,234 B2
(45) **Date of Patent: *Jan. 9, 2024**

(54) CONTAINER WITH CAP

(71) Applicant: Henkel AG & Co. KGaA, Duesseldorf (DE)

(72) Inventors: Dannielle Paola Borger, Herkenboosch (NL); Ingomar Henning, Cologne (DE); Willem Ramon, Woerden (NL); Gerrit Jan Stegeman, Laren GLD (NL); Lenny Marita Ellenkamp-van Olst, Doetinchem (NL)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/373,744

(22) Filed: Jul. 12, 2021

(65) Prior Publication Data

US 2021/0339918 A1 Nov. 4, 2021

Related U.S. Application Data

(63) Continuation of application No. 16/419,442, filed on May 22, 2019, now Pat. No. 11,059,635, which is a (Continued)

(30) Foreign Application Priority Data

Nov. 22, 2016 (DE) ..... 102016223043.3

(51) Int. Cl.

| | |
|---|---|
| ***B65D 47/12*** | (2006.01) |
| ***B65D 41/28*** | (2006.01) |
| ***B65D 47/18*** | (2006.01) |
| ***B65D 47/40*** | (2006.01) |
| ***B65D 41/26*** | (2006.01) |
| ***B65D 41/04*** | (2006.01) |

(52) U.S. Cl.
CPC ..... *B65D 47/122* (2013.01); *B65D 41/0442* (2013.01); *B65D 41/0471* (2013.01); (Continued)

(58) Field of Classification Search
CPC ..... B65D 47/122; B65D 41/28; B65D 47/18; B65D 47/40
See application file for complete search history.

(56) References Cited

U.S. PATENT DOCUMENTS 4,331,249 A * 5/1982 Banich, Sr. ..... B65D 41/0442 215/343
4,570,811 A * 2/1986 Lecinski ..... B65D 41/0442 215/343
4,697,716 A * 10/1987 Mumford ..... B65D 41/0442 215/352

(Continued)

FOREIGN PATENT DOCUMENTS

GB 2375760 A * 11/2002 ..... B65D 41/045
JP 2001080659 A * 3/2001 ..... B65D 41/3428

*Primary Examiner* — James N Smalley
(74) *Attorney, Agent, or Firm* — Bojuan Deng

(57) ABSTRACT

A container having a cylindrical pouring nozzle with an external thread and with a stop; a cap with an internal thread which can be screwed onto the external thread of the pouring nozzle as far as an end position in which the cap bears in the direction of rotation on the stop of the pouring nozzle; and a seal made of a material which is softer than a material of the cap and a material of the pouring nozzle. The seal is fixedly connected to the cap and has a first sealing element which, with the cap screwed on, is arranged in a radial direction between the cap and pouring nozzle and bears on a lateral surface portion of the pouring nozzle.

10 Claims, 5 Drawing Sheets

Related U.S. Application Data continuation of application No. PCT/EP2017/079232, filed on Nov. 14, 2017.

(52) U.S. Cl.
CPC ..... *B65D 41/26* (2013.01); *B65D 41/28* (2013.01); *B65D 47/123* (2013.01); *B65D 47/18* (2013.01); *B65D 47/40* (2013.01)

(56) References Cited

U.S. PATENT DOCUMENTS 4,844,273 A * 7/1989 Hawkins ..... B65D 41/0414 215/343
5,101,993 A * 4/1992 Nairn ..... B65D 47/123 215/232
5,207,345 A * 5/1993 Stewart ..... B65D 43/0229 220/326
6,708,839 B2 * 3/2004 Diesterbeck ..... B65D 1/46 206/508
6,871,752 B2 * 3/2005 Montgomery ..... B65D 41/0414 215/331
2002/0162818 A1 * 11/2002 Williams ..... B65D 41/3447 215/349
2003/0127421 A1 * 7/2003 Ziegler ..... B65D 41/045 215/349
2007/0187352 A1 * 8/2007 Kras ..... B65D 41/3409 215/276

* cited by examiner

CONTAINER WITH CAP

FIELD OF THE INVENTION

The invention relates to a container which comprises a cylindrical pouring nozzle having an outer thread and a cap having an inner thread for screwing onto the pouring nozzle. In the process, the cap can be screwed as far as an end position in which the cap abuts a stop of the pouring nozzle in the direction of rotation. In the end position, the cap assumes a desired orientation with respect to a front face of the container, for example.

BACKGROUND OF THE INVENTION

A container in the form of a washing agent bottle is known from the prior art, in which container an annular seal is provided for sealing between the cap, in the form of a screw closure, and the pouring nozzle. In this case, the seal is made of a material that is softer than a material of the cap and than a material of the pouring nozzle. The seal is arranged between an end edge of the pouring nozzle and an end contact surface of the cap in the axial direction. When the cap is screwed onto the pouring nozzle, the soft seal is compressed in the axial direction.

If the bottle having the pouring nozzle closed by means of the screw closure is also distributed by means of electronic commerce (e-commerce), it cannot be precluded that the bottle is in any position for a long period of time in the event of delivery by means of a parcel service, for example, and is upside down, for example. This imposes high requirements for sealing between the screw closure and pouring nozzle which the above-described axial seal does not always meet. More stringent requirements arise when the bottle is filled with a liquid washing agent which typically contains surfactants. The lower surface tension of the liquid increases the risk of leakage. Due to production tolerances, it cannot be precluded that although the desired end position is achieved when the cap is screwed on, the axial seal is not compressed to the extent required in order to be able to seal satisfactorily.

BRIEF SUMMARY OF THE INVENTION

The object of the invention is therefore to provide a container having a pouring nozzle and a cap, which container meets high requirements with regard to sealing between the pouring nozzle and the cap.

The object of the invention is achieved by the combination of features according to the claims. Embodiments of the invention can be found in the claims.

According to the invention, the seal comprises a first sealing element which is arranged between the cap and the pouring nozzle in the radial direction when the cap is screwed on and abuts a lateral surface portion of the pouring nozzle. The first sealing element can therefore also be referred to as a radial sealing element, as it is arranged in the radial direction between the components to be sealed. The first sealing element can be designed as a peripheral sealing lip, for example, it being possible for the sealing lip to have a thickness of less than 0.5 mm in profile in the radial direction. For example, the thickness of the first sealing element may be 0.2 to 0.4 mm in the radial direction.

The cap for the pouring nozzle can be designed as a closure cap, for example, in order to close the pouring nozzle. In another embodiment, the cap is designed as a pouring aid. The pouring aid may comprise a specific pouring spout which is intended to make it easier to pour liquid out of the container through the pouring nozzle. Owing to the stop of the pouring nozzle, it can be ensured that the pouring aid having the pouring spout is properly oriented with respect to the front face and/or to a handle of the container.

Preferably, the pouring aid comprises an outer thread onto which the inner thread of an additional cap can be screwed. This additional cap may be the above-described closure cap, for example. The closure cap can therefore be screwed onto the pouring nozzle both directly and indirectly via the pouring aid. In the latter case, the pouring aid is screwed onto the pouring nozzle and the closure cap is screwed in turn onto said pouring aid. In order to define an end position of the closure cap with respect to the pouring aid, the pouring aid can comprise a stop beyond which the closure cap cannot be screwed onto the pouring aid.

The cap may comprise a substantially cylindrical outer wall and a substantially cylindrical inner wall which define a receiving space, in the form of an annular cylinder, for the pouring nozzle. The cylindrical outer wall and/or the cylindrical inner wall may comprise shoulders, conical portions, threads etc., due to which the outer wall and/or the inner wall deviate from a mathematically exact cylindrical lateral surface. Correspondingly, the receiving space is not a mathematically exact annular cylinder.

The seal may be arranged in the receiving space at a front end of the receiving space. Preferably, this front end is a closed end of the receiving space. The receiving space is open at the opposite side so that the pouring nozzle can be moved in the receiving space when the cap is screwed on. When the cap is screwed on in the end position, only an upper end of the pouring nozzle can project into the receiving space.

In one embodiment, the seal and the cap are rigidly interconnected. Preferably, the rigid connection between the seal and the cap is established only when the cap and seal are produced, it being possible for both components to be produced by injection molding and one component to be injected onto the other. In the process, the seal is first injection-molded onto or around which seal the cap is injected.

The seal may comprise a first leg and a base, the first sealing element being arranged on the first leg and possibly comprising a bulge facing the receiving space. A rear face of the first leg can abut a lateral surface portion of the inner wall of the cap and can be rigidly connected thereto. The first leg extends in the axial direction along the lateral surface portion of the inner wall of the cap.

When the cap is mounted, the first sealing element closes the gap produced between the lateral surface portion of the inner wall of the cap and the lateral surface portion of the pouring nozzle. The two lateral surface portions are radially opposite one another. The bulge, which is convex in cross-section, abuts the lateral surface portion of the pouring nozzle. Due to the bulge, there is an undercut in the axial direction. This undercut can, as described in more detail below, be used to hold the seal in a fixed position inside an injection mold for the cap when the cap is produced.

In one embodiment, the seal comprises a second sealing element on the base, which sealing element is arranged between the cap and the pouring nozzle in the radial direction when the cap is screwed on and abuts an end edge of the pouring nozzle. The seal therefore provides two-fold sealing: firstly by means of the first sealing element, which is arranged between two surfaces to be sealed in the radial direction, and secondly by means of the second sealing element, which is arranged between two surfaces to be sealed in the axial direction. The thickness of the second sealing element in the axial direction is preferably greater than 0.5 mm. In one embodiment, this thickness is 0.7 to 1.7 mm. The thickness of the second sealing element in the axial direction is therefore greater than the thickness of the first sealing element in the radial direction.

A rear face of the base can abut a radial web of the cap. In the above-mentioned embodiments, which comprise an annularly cylindrical receiving space, the preferably peripheral radial web interconnects the inner wall and the outer wall of the cap.

In one embodiment, front faces of the seal facing the receiving space are free of production-related surface structures. Surface structures of this kind may be, for example, injection points which can be produced in the event of injection molding. The front faces of the seal can therefore be particularly smooth, which is conducive to their sealing effect.

The preferably integral cap may be made of plastics material, preferably of polypropylene (PP). A plastics material is preferably also used for the material of the seal; in this case, thermoplastic elastomers (TPE) have proven particularly favorable. Although the material of the seal is softer, according to the invention, than the material of the cap and the material of the pouring nozzle, the material of the seal should not be too soft. Efficient sealing is achieved when the material of the seal has Shore A hardness of 30 to 90 or 60 to 80 ShA at 23° C.

A groove that is open to the receiving space and has groove side walls may be provided on the base of the seal, which groove side walls diverge towards a groove floor. In other words, the groove is an (additional) undercut which is used to hold the seal securely in place by means of a holding element while the cap is produced.

In one embodiment, the seal is substantially U-shaped and comprises a second leg which is connected to the first leg via the base. The second leg also extends in the axial direction. A rear face of the second leg is rigidly connected to a wall portion of the cap (for example the outer wall).

A protrusion oriented towards the receiving space may be provided on the second leg, which protrusion produces an (additional) undercut in the axial direction.

The above-described undercuts ensure a rigid connection between the seal and a holding device for the seal. The holding device is used when the seal is produced and when the cap is produced preferably at a later point. The holding device is used as part of an injection mold for the seal in this case. After injection molding has taken place, the seal is placed into the injection mold of the cap by means of the holding device. The various undercuts and the U shape of the seal ensure that the seal is securely placed on the holding device, which makes it easier to produce the cap and the seal. In this case, the holding device may specify the inner contour of the receiving space of the cap at least in part. The holding device may be in several parts, so that said device can be pulled out of the receiving space after the cap has been injection molded. A specific design of the seal, which is also unrelated to other features of the invention such as the stop, is therefore disclosed here, which design is used for rigid connection between the seal and the holding element in order to, for example, hold the seal in position in an additional production step, in particular when another material is injected around the seal.

BRIEF DESCRIPTION OF THE DRAWINGS

The invention is described in more detail with reference to the embodiments shown in the drawings, in which.

DETAILED DESCRIPTION OF THE INVENTION

Figure 1:
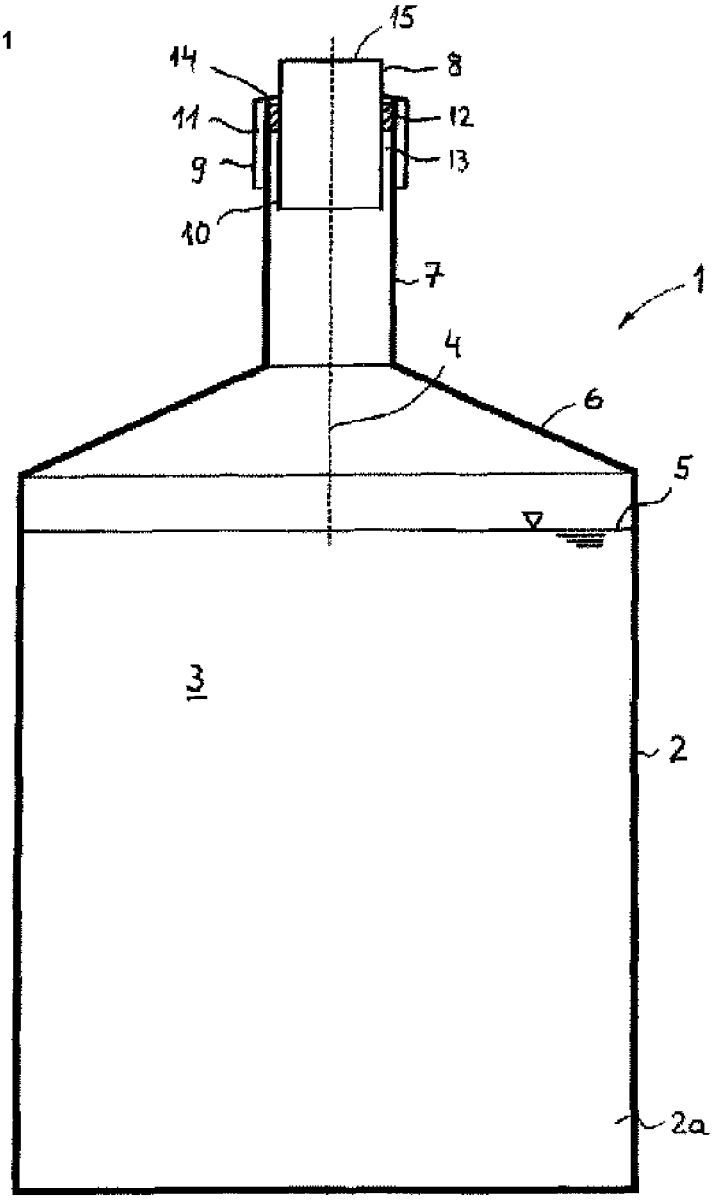
FIG. 1 is a schematic sectional view of a container having a cap.

FIG. 1 is a schematic view of a container 1 having a main body 2, which comprises a flattened front face 2*a*. The main body 2 is filled nearly completely with a liquid washing agent 3, which can be seen at a fill level line 5. A tapering region 6 adjoins an upper end of the main body 2, which region is conical in this case and transitions into a cylindrical pouring nozzle 7 having a central axis 4. The main body 2 may also have other shapes; for example, a handle may be molded into the main body 2. The region 6 tapering between the main body 2 and the pouring nozzle 7 does not necessarily have to be conical.

The container 1 further comprises a cap 8, which has a cylindrical basic form in the shape of an upside-down pot or cup and is mounted on the pouring nozzle 7. The cap 8 comprises a cylindrical outer wall 9 and a cylindrical inner wall 10, which define a receiving space 11. Owing to the cylindrical walls 9, 10, the receiving space 11 assumes the shape of an annular cylinder.

An annular seal 12 is arranged in the receiving chamber 11, which seal, proceeding from the central axis 4, is arranged between the inner wall 10 and an upper end of the pouring nozzle 7 in the radial direction. The seal 12 therefore seals an annular gap 13 between the inner wall 10 of the cap 8 and the pouring nozzle 7. A typical gap size for the gap 13 (radial distance between the pouring nozzle 7 and the inner wall 10) is 0.2 to 1.5 mm, preferably 0.2 to 1 mm, more preferably 0.2 to 0.5 mm, in the region of the seal. Correspondingly, the seal 12 is also 0.2 to 1.5 mm, preferably 0.2 to 1 mm, more preferably 0.2 to 0.5 mm, it being possible for said seal to be compressed when in the position shown. The non-compressed seal 12 may have a thickness of 0.2 to 1.5 mm, preferably 0.2 to 1 mm, more preferably 0.2 to 0.5 mm, in the radial direction.

The receiving space 11 is delimited by a peripheral radial web or connecting ring 14 at an upper end. The radial web 14 connects the outer wall 9 and the inner wall 10 in this case. The upper end of the receiving space 11 is closed by the radial web 14.

In order to remove the washing agent 3 from the container 1, the cap 8 is detached from the pouring nozzle 7. FIG. 1 does not show any threads by means of which the cap 8 can be screwed onto the pouring nozzle 7.

In the embodiment in FIG. 1, the cap 8 is designed as a closure cap 15. The function of the cap 8 in FIG. 1 consists in sealing the pouring nozzle such that no washing agent 3 can escape from the container 1 unintentionally. In particular, the seal 12 is to be designed such that no washing agent 3 escapes from the container when the container 1 is horizontal or upside down and the liquid washing agent 3 is in direct contact with the seal 12.

In one embodiment, the volume of the main body is 0.5 to 51. An inner diameter of the cylindrical pouring nozzle is preferably between 30 and 50 mm. It should be emphasized at this point that FIG. 1 shows the container according to the invention only schematically and the length ratios shown in FIG. 1 are not limiting. An axial length of the pouring nozzle, for example, can therefore be smaller than the inner diameter (e.g. 10 to 30 mm). The conical region 6 may also be so flat that the pouring nozzle 7 virtually directly adjoins the main body 2.

Components or features that are identical or similar to components and features denoted in FIG. 1 are provided with the same reference signs in the other drawings.

Figure 2:
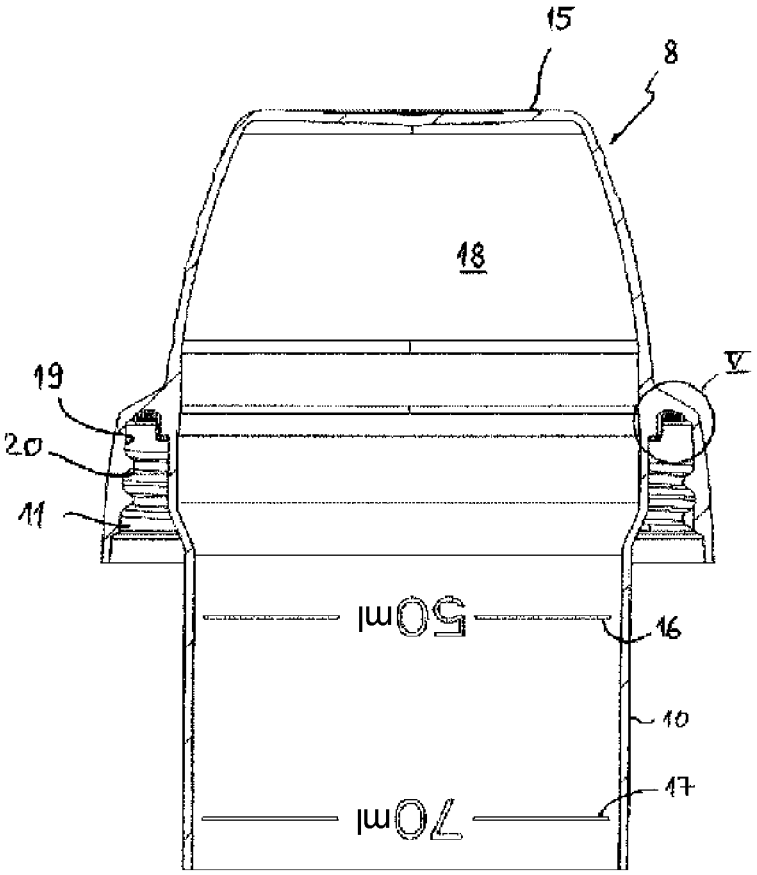
FIG. 2 is a cross section of a closure cap.

FIG. 2 is a cross section of an embodiment for the cap 8 also in the form of a closure cap 15. In addition to the closure cap 15 in the embodiment of FIG. 1, the closure cap 15 of FIG. 2 has the function of a measuring cup or a dosing cap, which is clear from two graduations 16, 17 (50 ml and 70 ml). In order to measure 50 ml, for example, the closure cap 15 has to be rotated by 180° starting from the position shown in FIG. 2 and the dispensing chamber 18 delimited by the inner wall 10 has to be filled as far as the graduation 16.

An inner thread 20 is provided on an inner face 19 of the outer wall 9 facing the receiving space 11, by means of which inner thread the closure cap 15 of FIG. 2 could be screwed onto a pouring nozzle 7 having a corresponding outer thread. The pouring nozzle 7 is provided with a stop which defines an end position for the cap in the direction of rotation or screwing, beyond which end position it is not possible to screw and in which position the cap is corresponding oriented with respect to the front face 2*a*. Preferably, the stop is designed as a stopping edge which the beginning of a thread of the cap strikes in the end position. This produces positive engagement between the cap and the pouring nozzle in the end position in the direction of rotation.

Figure 5:
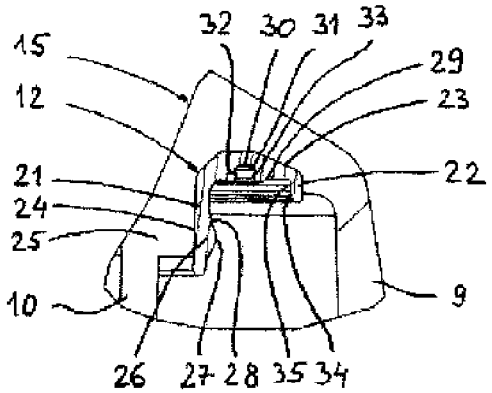
FIG. 5 is an enlarged view of a seal in the closure cap.

The seal 12 is mounted in the upper end of the receiving space 11, in a specific design in this case. FIG. 5 shows the seal 12 on an enlarged scale, which is indicated by the circle denoted by V in FIG. 2. As can be seen in particular in FIG. 5, the seal 12 directly abuts the inner face of the connecting ring 14. The peripheral seal 12 of FIG. 5 is substantially U-shaped in profile and comprises a first leg 21, a second leg 22 and a base 23, which connects the two legs 21, 22. The rear face 24 of the first leg 21 abuts a lateral surface portion 25 of the inner wall 10. In this case, the diameter of the lateral surface portion 25 is greater, preferably by 1 to 4 mm, than the diameter of other portions of the inner wall 10.

A first sealing element 26 is arranged on the first or radially inner leg 21, which element comprises a convex bulge 27 which is formed in the direction of the inner face 19 of the outer wall 11. In the illustration in FIG. 5, a first undercut 28 is produced above the bulge and in the direction of the base 23. The undercut 28 corresponds to an axial direction, i.e. to a direction that is in parallel with the central axis 4 (see FIG. 1).

A second sealing element 29 having a groove or recess 30 is provided on the base 23. The groove 30 comprises two groove side walls 32, 33 which diverge towards a groove floor 31, so that the groove 30 is also undercut in the axial direction. A protrusion 34 oriented in the direction of the first leg 21 is provided on the second or radially outer leg 22, which is shorter than the first leg 21, by means of which protrusion an undercut 35 is also provided on the second leg 22 in the axial direction.

Owing to the specific design of the seal 12 having the opposing legs 21, 22 and the undercuts 28, 35 and the undercut groove 30 on the base 23, the seal 12 is positioned securely on a part of the injection mold that is necessary for injection molding the seal, after injection molding has taken place. This part is also referred to in the following as a holding element. When the seal 12 is injection molded, the holding element defines the inner contour of the seal 12. For subsequent production of the cap 8, the seal 12 and the holding element protrude into the injection mold for the cap 8. The material for the cap 8 is injected onto the seal 12. Owing to the secure position of the seal 12 on the holding element, the seal 12 remains in the desired position while the cap 8 is injection molded.

Figure 3:
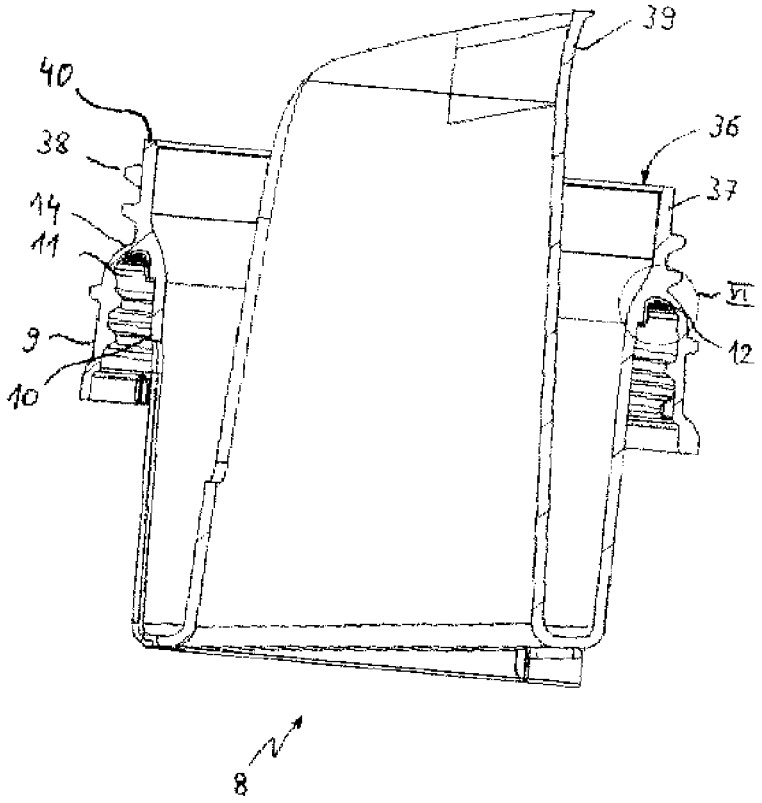
FIG. 3 is a cross section of a pouring aid.
Figure 6:
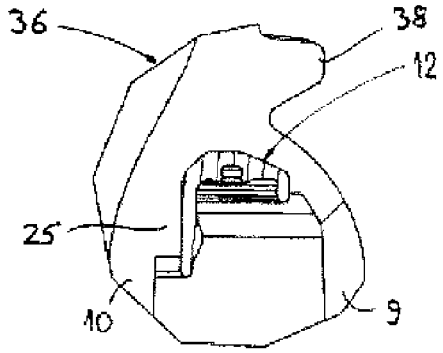
FIG. 6 is an enlarged view of a seal in the pouring aid.

FIG. 3 shows another embodiment of the cap 8, although this time in the form of a pouring aid 36. The pouring aid 36 is similar to the closure cap 15 with regard to the receiving space 11 delimited by the outer wall 9 and the inner wall 11. This is clear from viewing FIGS. 5 and 6 in combination, where FIG. 6 is an enlarged view of the seal 12 of the pouring aid 36 (cf. the circle denoted by VI in FIG. 3). Analogously to the closure cap 15, the pouring aid 36 can also be screwed onto a pouring nozzle 7 provided with an outer thread. As the closure cap 15 can also be screwed directly onto the pouring nozzle 7 comprising an outer thread 38, a variably usable vessel is therefore disclosed. The vessel comprises the main body 2 having a region 6 preferably integrally formed therewith and a pouring nozzle 7 as well as the removable closure cap 15 and the removable pouring aid 36. If required, the pouring aid 36 can be screwed onto the pouring nozzle 7, it furthermore being possible to fasten the closure cap 15 to the pouring nozzle 7 in a similar manner, although in this case directly via the pouring aid 36.

Figure 4:
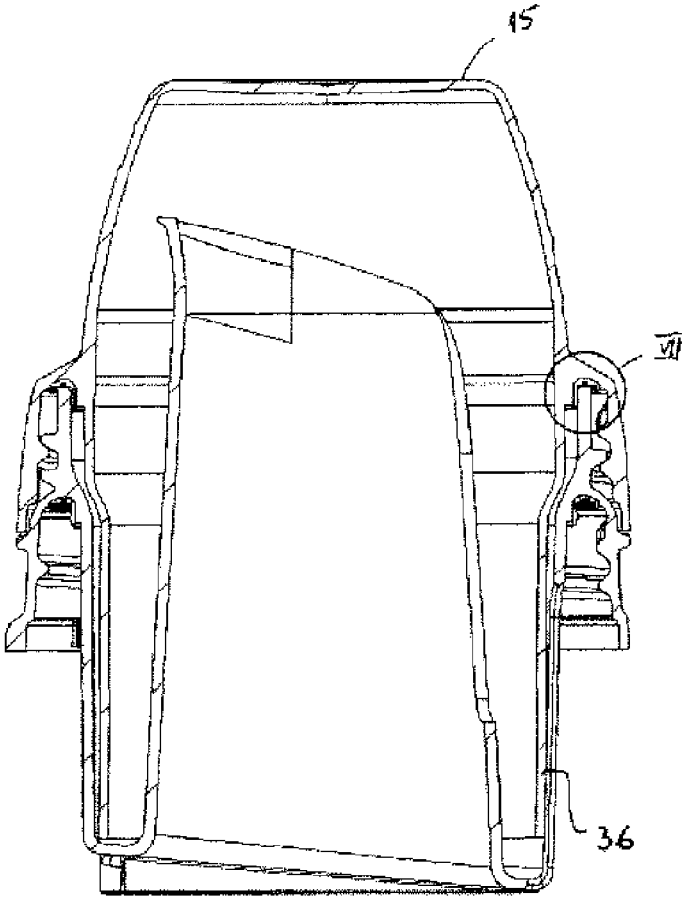
FIG. 4 is a cross section of the closure cap and the pouring aid.

A nozzle portion 37 having an outer thread 38 is arranged above the radial web 14. The dimensions of the nozzle portion 37 and the outer thread 38 are selected such that the closure cap 15 can be screwed onto the pouring aid 36. FIG. 4 shows the closure cap 15 and the pouring aid 36 when screwed together. In order to achieve a specific orientation of the closure cap 15 with regard to the pouring aid 36, an abutment edge can be provided on the outer thread 38 in a similar manner to the outer thread of the pouring nozzle 7.

A significant feature of the pouring aid 36 is the pouring spout denoted by the numeral 39. The pouring spout 39 extends from a lower end, which is formed on an end of the inner wall 10, in the axial direction beyond an upper end edge 40 of the nozzle portion 37.

Figure 7:
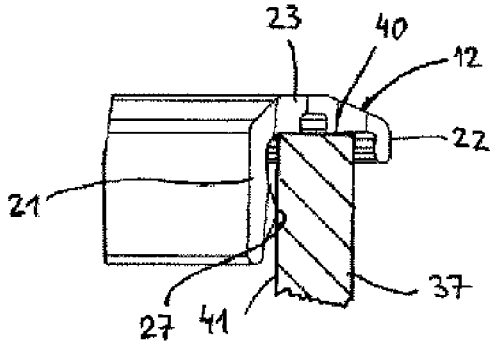
FIG. 7 shows the seal with an upper part of a pouring nozzle.

FIG. 7, which is an enlarged view of the seal 12 that is encircled by the circle denoted by VII in FIG. 4, shows the interaction of the seal 12 and the nozzle portion 37 of the pouring aid 36. Theoretically, the nozzle portion 37 could be replaced by the upper end of the pouring nozzle 7 of the container 1. The nozzle portion 37 and the pouring nozzle 7 do not differ with respect to interaction with the seal 12.

In one embodiment of the invention, a lateral surface portion 41 of the nozzle portion 37 abuts the bulge 27 at a specific pressure, such that a first sealing is thus produced between the closure cap 15 bearing the seal 12 and the pouring aid 36. The first sealing is independent of the end position of the screw movement in this case. The first sealing element 26 already demonstrates its (total) effect when the bulge 27 presses against the nozzle portion 37 or the pouring nozzle 7 in the radial direction.

A second sealing takes place due to the interaction of the second sealing element 29 and the upper end edge 40 of the nozzle portion 37. However, the second sealing element 29 acting in the axial direction demonstrates its effect only when the closure cap 15 has been completely screwed onto the pouring aid 36 as far as the end position. However, due to production tolerances, the second sealing element may be compressed insufficiently, which impairs the sealing function of the second sealing element 29.

The embodiment according to the invention therefore achieves two-stage sealing, the sealing induced by the first sealing element 26 acting in the radial direction and the sealing induced by the second sealing element 29 acting in the axial direction. The material of the seal is softer than the material of the cap 8 and softer than the material of the pouring nozzle 7.

In one embodiment of the invention, the end position of the screw movement is configured such that a total sealing effect is already achieved before the end position has been reached by the first sealing element 26. Preferably, there is a gap of greater than or equal to 0.15 mm between the closure cap 15 securely screwed onto the pouring aid 36 and the end edge 40 of the nozzle portion 37 at the end position in the axial direction. This produces an optimal radial seal over an increased dimensional tolerance, which seal also has an increased resistance to congestion.

The interaction described here between the nozzle portion 37 of the pouring aid 36 and the seal 12 relates to the connection of the pouring aid 36 and the closure cap 15. The above-mentioned embodiment applies by analogy to the possible connection between the pouring nozzle 7 and the closure cap 15 and to the possible connection between the pouring nozzle 7 and the pouring aid 36.

The sealing by means of the first sealing element 26, which acts in the radial direction, is therefore essential to the invention. The provision of the second sealing element 29, which acts in the axial direction, is therefore merely one embodiment of the invention. Correspondingly, the seal 12 may deviate from the specific design as shown in detail in FIGS. 5 to 7, in particular with regard to the base, which supports the second sealing element 29. Therefore, although the seal may be U-shaped in profile (two legs extend in the axial direction and the base extends transversely thereto), a second sealing element 29 or at least the sealing function thereof can be dispensed with. In particular, the end position, established by the stop, of the cap 8 (for example in the form of the closure cap 15 or the pouring aid 27) on the pouring nozzle 7 or the end position of the closure cap 15 on the pouring aid 27 can, as already explained above, be defined such that in the end position, a gap remains between the upper edge 40 of the nozzle portion 37 and the closure cap 15 arranged thereabove or between an upper edge of the pouring nozzle 7 and the cap 8 positioned thereon.

LIST OF REFERENCE NUMERALS

1 container
2 main body
3 washing agent
4 central axis
5 fill level line
6 region, tapering region
7 pouring nozzle
8 cap
9 outer wall
10 inner wall
11 receiving space
12 seal
13 gap
14 radial web/connecting ring
15 closure cap
16 graduation
17 graduation
18 dispensing chamber
19 inner face
20 inner thread
21 first leg
22 second leg
23 base
24 rear face
25 lateral surface portion
27 bulge
28 first undercut
29 second sealing element
30 groove
31 groove floor
32 groove side wall
33 groove side wall
34 protrusion
35 second undercut
36 pouring aid
37 nozzle portion
38 outer thread
39 pouring spout
40 upper edge
41 lateral surface portion

What is claimed is:

1. A container comprising a cylindrical pouring nozzle having an outer thread and a stop, a cap having an inner thread, which can be screwed onto an outer thread of the pouring nozzle as far as an end position in which the cap abuts the stop of the pouring nozzle in the direction of rotation, a seal made of a material that is softer than a material of the cap and a material of the pouring nozzle, wherein the seal is rigidly connected to the cap and comprises a first sealing element which is arranged between the cap and the pouring nozzle in a radial direction when the cap is screwed on and abuts a lateral surface portion of the pouring nozzle, wherein the seal comprises a first leg, a second leg, and a base, wherein the second leg is connected to the first leg via the base, and wherein the cap comprises a cylindrical outer wall and a cylindrical inner wall which define a receiving space in the form of an annular cylinder for the pouring nozzle, the seal being arranged in the receiving space at a front end of the receiving space.

2. The container according to claim 1, wherein a sealing face of the seal facing the receiving space is free of production-related surface structures.

3. The container according to claim 1, wherein the first sealing element is arranged on the first leg and comprising a bulge facing the receiving space.

4. The container according to claim 3, wherein the seal is U-shaped.

5. The container according to claim 1, wherein the seal is U-shaped.

6. The container according to claim 1, wherein a groove that is open to the receiving space and has groove side walls is provided on the base, which groove side walls diverge towards a groove floor.

7. A container comprising a cylindrical pouring nozzle having an outer thread and a stop, a cap having an inner thread, which can be screwed onto an outer thread of the pouring nozzle as far as an end position in which the cap abuts the stop of the pouring nozzle in the direction of rotation, a seal made of a material that is softer than a material of the cap and a material of the pouring nozzle, wherein the seal is rigidly connected to the cap and comprises a first sealing element which is arranged between the cap and the pouring nozzle in a radial direction when the cap is screwed on and abuts a lateral surface portion of the pouring nozzle, wherein the cap comprises a cylindrical outer wall and a cylindrical inner wall which define a receiving space in the form of an annular cylinder for the pouring nozzle, the seal being arranged in the receiving space at a front end of the receiving space, wherein a groove that is open to the receiving space and has groove side walls is provided on the base, which groove side walls diverge towards a groove floor.

8. The container according to claim 7, wherein the seal comprises a first leg and a base, the first sealing element being arranged on the first leg.

9. The container according to claim 8, wherein the seal is substantially U-shaped and comprises a second leg which is connected to the first leg via the base.

10. The container according to claim 9, wherein a protrusion oriented towards the receiving space is provided on the second leg.

* * * * *